US006564400B2

(12) United States Patent
Kelly et al.

(10) Patent No.: US 6,564,400 B2
(45) Date of Patent: May 20, 2003

(54) CONTINUOUS TUBE COT ASSEMBLY

(75) Inventors: Ray G. Kelly, St. Louis, MO (US); David A. Curry, Washington, MO (US)

(73) Assignee: AGI, LLC, Pacific, MO (US)

( * ) Notice: Subject to any disclaimer, the term of this patent is extended or adjusted under 35 U.S.C. 154(b) by 0 days.

(21) Appl. No.: 10/040,034

(22) Filed: Oct. 19, 2001

(65) Prior Publication Data

US 2003/0074733 A1 Apr. 24, 2003

(51) Int. Cl.[7] ..... A47C 17/64
(52) U.S. Cl. ..... 5/8; 5/110; 5/187
(58) Field of Search ..... 5/8, 110, 187, 5/194, 196, 400

(56) References Cited

U.S. PATENT DOCUMENTS

| | | | | |
|---|---|---|---|---|
| 1,566,574 A | | 12/1925 | Birg | 5/114 |
| 1,820,284 A | * | 8/1931 | Mills | 119/28.5 |
| 1,820,285 A | | 8/1931 | Mills | 5/187 |
| 2,532,837 A | | 12/1950 | De Puy | 311/106 |
| 2,670,478 A | | 3/1954 | Gilfillan | 5/114 |
| 2,924,830 A | | 2/1960 | De Long | 5/8 |
| 3,574,871 A | | 4/1971 | Greene | 5/82 |
| 4,742,587 A | | 5/1988 | Dove | 5/82 |
| 4,958,390 A | | 9/1990 | Mendenhall | 5/110 |
| 5,003,649 A | * | 4/1991 | Kelly | 5/8 |
| 5,499,416 A | | 3/1996 | Daouk | 5/625 |
| 5,561,876 A | * | 10/1996 | Petruzella | 5/724 |
| 5,960,739 A | | 10/1999 | Storm | 5/110 |
| 5,992,348 A | | 11/1999 | Harding | 5/110 |
| 6,345,400 B2 | * | 2/2002 | Elliott et al. | 5/110 |
| 6,370,714 B1 | * | 4/2002 | Elzenbeck | 5/110 |

FOREIGN PATENT DOCUMENTS

| | | | |
|---|---|---|---|
| CH | 261936 | 6/1949 | 5/112 |

* cited by examiner

*Primary Examiner*—Michael F. Trettel
(74) *Attorney, Agent, or Firm*—Woodard, Emhardt, Naughton, Moriarty & McNett LLP

(57) ABSTRACT

The present invention provides a cot assembly that includes a frame, supporting corner pieces and bedding material. The frame is preferably of a one or two piece construction and is shaped into a perimeter defining an interior area. Corner pieces support the frame above an external support surface. The bedding material extends across the interior of the frame and into the corner pieces without any gaps between the material, the frame and corner pieces, thereby protecting against injury which could otherwise result from the presence of such gaps. The continuous frame maintains the cot's rigidity while the corner pieces lower the cot's profile for stacking. The cot includes at least a number of corner pieces corresponding to the corners of the polygonal shape. A pedestal extends downwardly from each corner piece to engage the floor or other supporting surface. In a preferred form, each of the corner pieces includes top and bottom portions defining a slot therebetween for receiving the bedding material. In a further aspect of the present invention, the cot assemblies can be stacked. Preferably a plurality of stackable cots can be vertically stacked such that each pocket in a cot assembly slidably receives a corresponding pedestal of the cot assembly placed atop it. Further, cot assembly frame has a height and the height of the stacked cots is only increased by approximately the height of the frame each time a cot is placed atop the stack.

24 Claims, 9 Drawing Sheets

CONTINUOUS TUBE COT ASSEMBLY

FIELD OF THE INVENTION

The present invention relates generally to cots, and more particularly to an improved design for a cot assembly. The invention further relates to cots having various advantageous features, including a continuous bedding surface without gaps, increased rigidity, and an improved low profile for stacking.

BACKGROUND OF THE INVENTION

Cots provide a temporary sleeping surface positioned above the ground or floor. Preferably, the cot is easily moved and transported and/or stored for later use. Cots find a wide variety of uses in many different activities for different ages and sizes of people. In one use, cots are used for camping or other outdoor sleeping settings to avoid contact with the ground. In another use, cots are used indoors by children or preschoolers when it is desired to provide a comfortable sleeping surface that is raised above the floor. Cots are more advantageous than mats or other devices that lie directly on the floor or ground for many reasons. For example, they provide a more comfortable sleeping surface, allow air flow between the floor or ground and the sleeping surface, provide a sleeping surface for a person which is not in contact with the sleeping surface of another person, and do not expose the sleeping person to filth and/or pests which may be present on the floor or ground.

One problem associated with cots is the fact that, when assembled, they require more storage space and can be more cumbersome than mats or sleeping bags. In order to address this problem, various improvements have been made in the design of cots. U.S. Pat. No. 5,003,649 to Kelly provides a nestable cot with a frame that allows a plurality of cots to be nestably stacked one on top of another. Each cot includes four corner pieces, each corner piece configured to receive a pedestal from a corresponding one of the corner pieces stacked thereupon. Thus, the stacked cots occupy a space that has a total height that is less than the sum of the individual heights of each cot, and are more easily stored and handled.

While the '649 patent is a step in the right direction in improving the design of cots, there remains room for additional improvements. One problem with prior art cots is related to the sleeping surface of the cots. Cots typically have a frame for supporting bedding material or fabric that extends between members of the frame. One of the problems with these prior art cots is that gaps are formed between the bedding material and the frame, and these gaps may pose a safety hazard, particularly for children. The potential for injury exists if a child inserts a hand, foot, head or other body part through the gap, where it may become stuck or may cause the child to trip and fall. Also, the cot is more susceptible to being damaged. Cots having such gaps, particularly at the corners, have been prevalent in the prior art and means have not been provided for ensuring against such gaps.

Another problem with prior art cots is related to maintaining the rigidity of the cots in a generally flat orientation. Most cots are based on a frame of multiple pieces connected to corner pieces or each other to form a frame. The tension on the frame from the bedding material can cause these pieces to warp or twist, imparting a warp or twist to the cot, inhibiting the cot from lying flat. This problem becomes worse over time as the cot is repeatedly subjected to loading.

While there have been various approaches to improving the design and construction of nestable cots, the need for improvement still remains. There is needed an improved cot that addresses the problems in the prior art in a reliable, safe, and efficient manner. The present invention satisfies these needs, among others.

SUMMARY OF THE INVENTION

The present invention provides a cot assembly that includes a frame, supporting corner pieces and bedding material. The frame is preferably of a one or two piece construction. Corner pieces support the frame above an external support surface. The bedding material extends across the interior of the frame and into the corner pieces without any gaps between the material, the frame and corner pieces, thereby protecting against injury which could otherwise result from the presence of such gaps. The continuous one or two piece frame maintains the cot's rigidity while the corner pieces lower the cot's profile for stacking. These unique features distinguish the present invention from the prior art and provide greater usable area within the perimeter, increased safety and utility, and other advantages in the use of the cot.

In one aspect of the present invention, there is a cot assembly that includes a frame shaped to define an interior area. The frame is preferably an elongated rod bent and curved to form a polygonal shape. The frame can be a continuous one-piece member welded together at its ends, or it may be formed in a one or two piece construction with one or two seams. The cot includes at least a number of corner pieces corresponding to the corners of the polygonal shape. At least a portion of the frame is received and held by each corner piece, preferably in a shaped groove. A pedestal extends downwardly from each corner piece to engage the floor or other supporting surface.

In one embodiment, for example, each corner piece includes an inwardly projecting portion extending into the interior area of the frame. Bedding material is connected with the frame and extends across the interior area of the frame and corner pieces such that no openings are formed in the interior area between the bedding material, the frame and the corner pieces. In a preferred form, each of the corner pieces includes top and bottom portions defining a slot therebetween for receiving the bedding material.

In a further aspect of the present invention, the cot assemblies can be stacked using the low-profile corner piece. Preferably a plurality of stackable cots can be vertically stacked such that each pocket in a cot assembly slidably receives a corresponding pedestal of the cot assembly placed atop it. Further, preferably each cot assembly frame has a height and the height of the stacked cots is only increased by approximately the height of the frame each time a cot is placed atop the stack.

It is an object of the present invention to provide a cot assembly which is simple in construction and which does not present fasteners or the like which may be encountered by or removed by the user, particularly children.

It is a further object of the present invention to provide a cot assembly which includes a frame with a supported bedding material that extends fully within the frame to avoid gaps between the bedding material and frame, thereby preventing the potential for a person having a part of the body become engaged or trapped within such a gap.

It is a still further object of the present invention to provide a cot with increased rigidity and a low profile for stacking.

These and other objects and advantages of the present invention will be apparent from the following description of the preferred embodiment.

DESCRIPTION OF THE PREFERRED EMBODIMENTS

Figure 1:
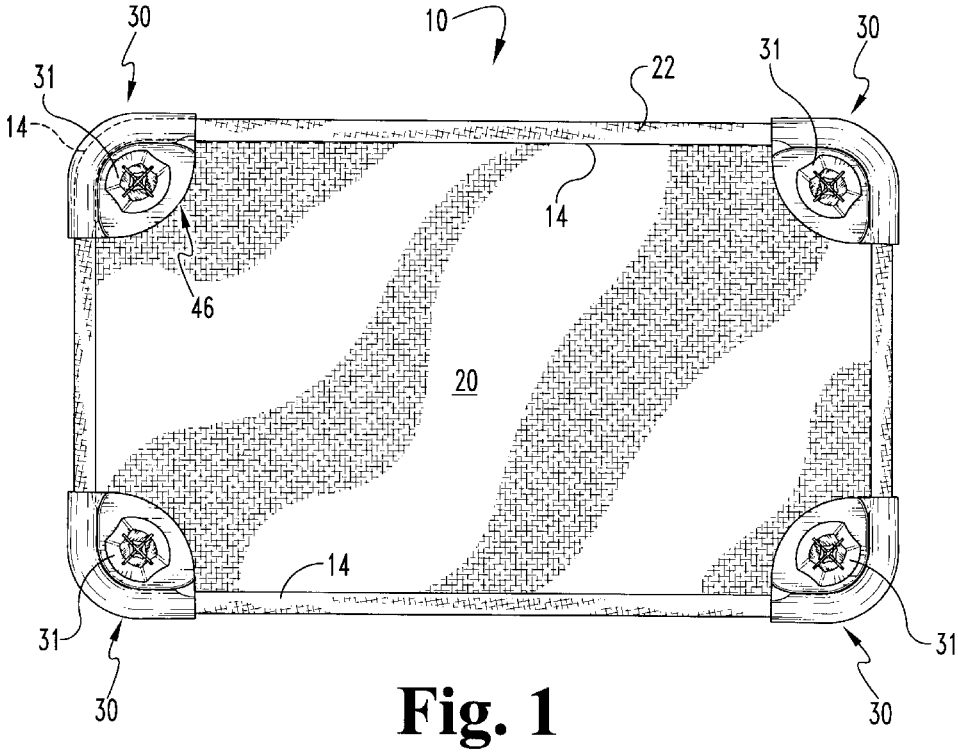
FIG. 1 is a top plan view of a cot assembly according to a preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a cot assembly that has several advantageous design features not available in the prior art. Importantly, the cot includes a bedding material that spans the entire interior of the cot frame without any gaps being present between the bedding material and the frame. This fully spanning bedding material is mounted on a continuous tube frame. The bedding material and tube frame are mounted to and supported by four corner pieces which securely and safely grip and hold the frame and material. The frame forms a perimeter which defines an interior area in which a person lying on the cot is supported. These features are provided in a cot assembly that is simple and reliable in construction, is easily assembled, and does not have exposed parts that may pose a problem for the user, particularly for children.

Figure 2:
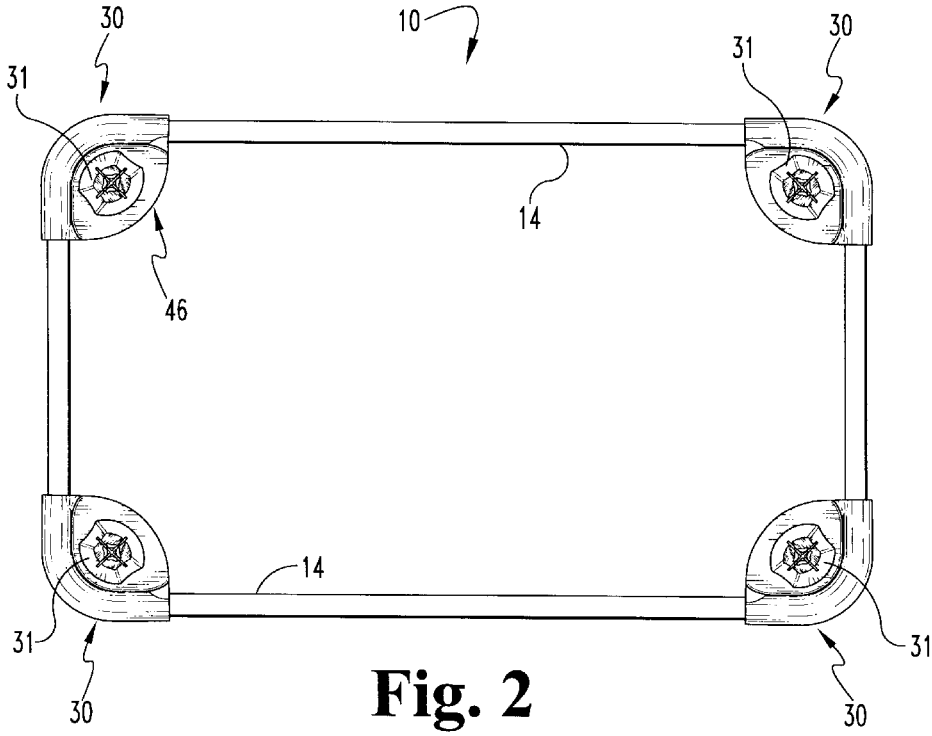
FIG. 2 is a top plan view of the cot frame of the embodiment of FIG. 1.

Referring in particular to FIGS. 1–2, there is shown a cot 10 having a frame 14 formed from a continuous piece of tubing. Four corner pieces 30 are mounted to and grip frame 14. It is contemplated herein that frame 14 may have a plan view forming any one of a number of polygonal shapes, such as a rectangle, square, pentagon, a combination of straight and curved members, or only curved members, etc., and includes a corresponding number of corner pieces 30. The frame is shown as consisting of a pipe generally comprised of a hollow tube either in a round or non-round cross-section.

The frame member is preferably an elongate member such as a metal pipe or tube which has been bent and curved to form the complete periphery of a polygonal shape and connected by welding or a similar fusion at the ends to form a one-piece continuous frame. Less desired but suitable alternatives would be a one-piece frame which has nested ends to form a continuous one-seam connection, or a continuous two piece frame with two nested end connections to form a two-seam connection. In a one or two-seam arrangement rivets, pins, screws or bolts may be used to keep the connections from being disassembled or twisting, but are less preferred due to the added complexity of assembly and the additional pieces required.

As used herein, the term "tube" is used more broadly as encompassing any elongated rod or member which can be curved and/or bent to form a frame for supporting the bedding material used in a typical cot. It will therefore be appreciated that such tubes may comprise any of a wide variety of materials and shapes depending on the intended use of the cot. A hollow galvinized steel pipe is one preferred material. Alternate materials such as molded or extruded plastic may also be used when made to have sufficient strength to support the taut bedding material during use, but which preferably are also lightweight to facilitate moving and stacking of the cots.

Figure 3:
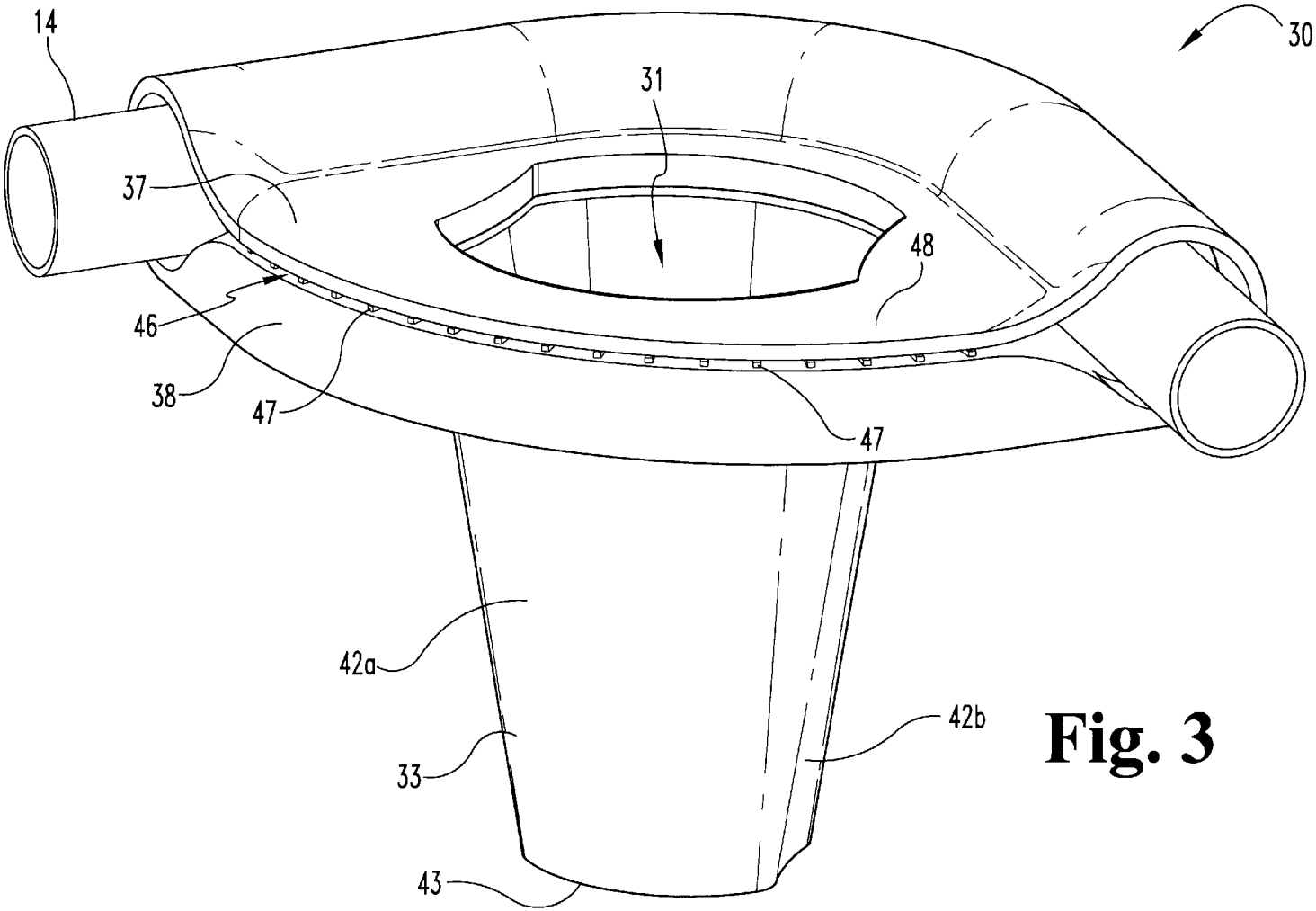
FIG. 3 is a perspective view of one corner of the cot assembly of FIG. 1.
Figure 4:
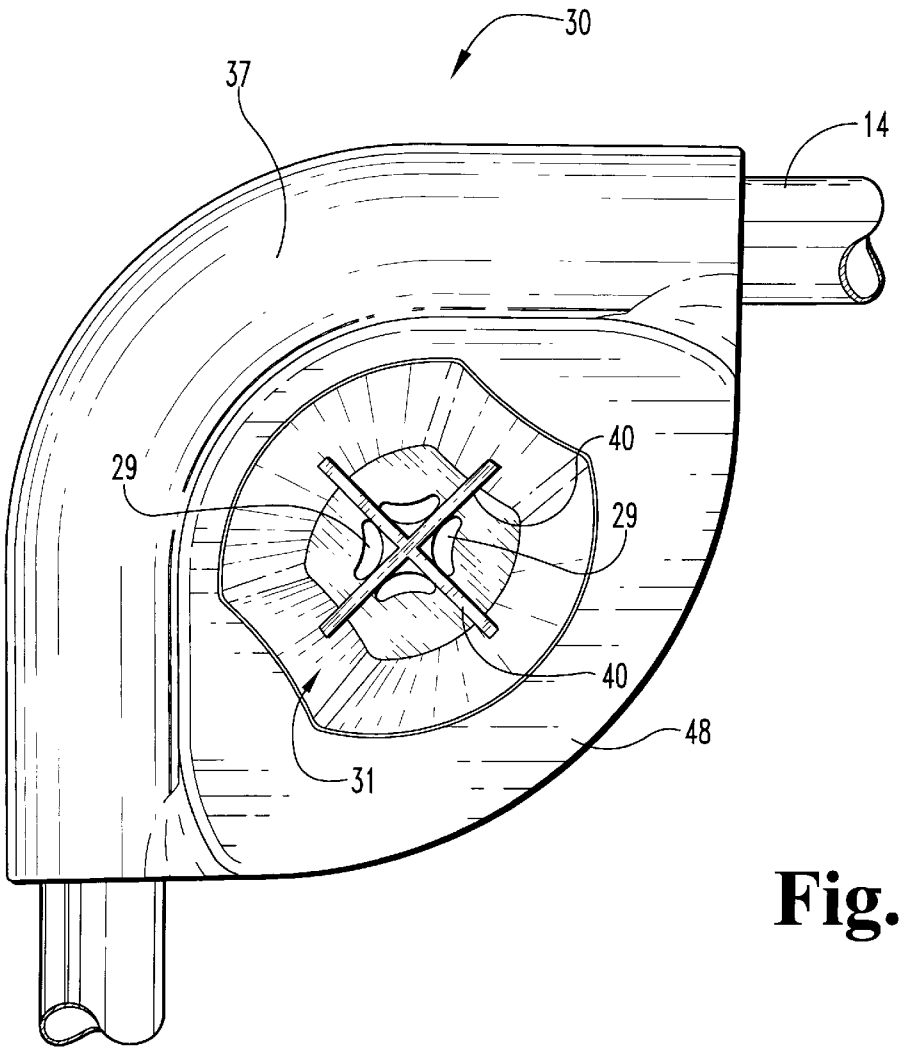
FIG. 4 is a top view of the corner piece of FIG. 3.

Bedding material 20 is connected with sleeves 22 to frame 14 and extends therebetween in the interior area of frame 14 to create a support surface for a person lying on the cot. The bedding material 20 extends horizontally substantially parallel to the floor or ground. Bedding material 20 and frame 14 are supported above the floor or ground by pedestals 33 (FIG. 3) extending downward from the corner pieces 30 to suspend the bedding surface above an underlying support surface. The bedding material 20 is made from a material of suitable strength and comfort to support a person lying on the cot 10, the selection of which is within the ordinary skill in the art. Bedding material is typically a relatively thin, flexible and compliant material, preferably sheet-like in shape. The material may be any suitable one, e.g., a natural or synthetic sheeting, fabric, mat, webbing or the like.

As previously described, the bedding material 20 and frame 14 are assembled such that there are no openings formed between the frame, bedding material and corner pieces in the interior area of the frame. The bedding material is attached to the frame, and any free portions of the bedding material will at least extend to or overlap with the frame. The bedding material may be attached to the frame either before or after the frame is completely assembled. If the bedding material is attached before frame assembly, the welding or seam connection process for the frame will need to avoid damage to the material. Alternately, if the frame is assembled first, the bedding material will need to be sewn in place on the frame or attached around the rigid frame.

It will be appreciated that there are numerous ways of attachment to accomplish gap free construction. In the preferred embodiment, the bedding material includes a plurality of sewn sleeves 22, each configured to enclose portions of frame 14. In an alternate method of attachment, bedding material 20 extends around the exterior portion of the frame 14 and is connected to the underside of the material or the frame by suitable fasteners, for example Velcro® hook and loop fasteners, snaps, buttons, zippers or other fasteners, the selection of which is within the ordinary skill in the art. Bedding material 20 is sized such that when the frame 14 and corner pieces 30 are assembled, as described above and shown in FIG. 1, the bedding material 20 fills the interior area of frame 14.

As used herein, the term "gap free" or similar terms are used to describe the fact that the bedding material fills the interior of the area defined by the frame perimeter and the corner pieces when viewed in the plan view. Moreover, a preferred feature of the present invention is the provision of a gap free condition that is maintained while the bedding material is stretched during use.

The cot frame 14 is illustrated in FIG. 2 without the bedding material in order to better depict the details of the frame 14 and its components. In the preferred embodiment illustrated, four corner pieces 30 hold and support frame 14. Preferably the frame has a length and width sufficient to accommodate the height of a person lying on the cot. It is of course contemplated that the length and width may be varied substantially to accommodate different users.

The continuous one-piece or two-piece frame 14 provides increased rigidity to prevent "racking" when the cots are subjected to a longitudinal twisting force. Racking occurs when round members of a frame rotate relative to the corner pieces or relative to each other, thereby skewing the otherwise flat shape of the cot, and causing a corner of the cot to be spaced from the underlying cot or ground when they are stacked or put on the floor. This can lead to instability of a stack of cots. For the present invention, since a continuous tube, one-seam, or two-seam frame minimizes rotation relative to itself, the potential for racking is avoided. In an alternate embodiment, frame 14 may include a non-circular cross-section such as a lower flat side or a hexagonal shape to additionally prevent twisting.

As an additional aspect of the invention, the continuous or one-piece construction of the frame places curved or "wrap-around" portions of the frame through corner pieces 30. Prior corner pieces have served as connectors between separate rods of a frame; however, the wrap-around curve of the frame in the present invention provides rigidity in three dimensions and prevents twisting or warp from being introduced at the corner piece.

As illustrated in detail in FIGS. 3–7, the assembly of the cot frame is straightforward. In summary, the frame 14 with bedding material 20 is placed on the lower portion 38 of each corner piece 30. The upper portion 37 of each corner piece is then aligned over the frame 14 and material 20. Upper portion 37 is then attached to lower portion 38. Material 20 is held on frame 14 and within a slot 46 defined as a short height in the cot's interior area between each corner upper portion 37 and lower portion 38.

As will be apparent from the later description of the corner pieces and associated components, the corner portions may be attached by press fit, gluing, mechanical fastening or any other means, with a simple mechanical "snap" fit of the components being preferred to simplify assembly and facilitate disassembly if that becomes desired. It is a preferred feature of the present invention that the upper and lower portions are molded as complete and interlocking pieces with no screws, pins or other fasteners required to hold the corners together. Therefore such fasteners are not exposed to the user, and cannot be removed by the user.

Each of the corner pieces 30 includes an upper portion 37 and a lower portion 38. In a preferred embodiment, upper portion 37 and lower portion 38 are each molded and formed in one piece, thus eliminating additional parts. Upper portion 37 and 38 are preferably made from injection molded plastic.

Lower portion 38 includes support means such as a leg or pedestal 33 defined by an outer wall surface 42*a* and 42*b*, which tapers to a reduced cross-section as it extends downwardly to bottom 43. Pedestal 33 has a height from the floor that positions bedding material 20 above the ground or floor.

Corner piece 30 also defines pocket 31 positioned through the interior of pedestal 33. Pocket 31 includes substantially vertical inner walls which preferably taper slightly inwardly in correspondence to outer walls 42*a* and 42*b* as they extend downwardly towards pedestal support surface(s) 40 positioned within pocket 31. Pedestal support surface(s) 40 provide internal bracing for pedestal 33 as well as limiting the nesting distance for stacked cots.

Bottom 43 of pedestal 33 defines at least one opening 29 communicating with the hollow interior of pocket 31. Openings 29 provide a passageway for air as a pedestal is inserted into or removed from the pocket 31, thus facilitating the stacking and unstacking of cots. Openings 29 also facilitate drainage of the pedestal when a cot is being cleaned.

Figure 5:
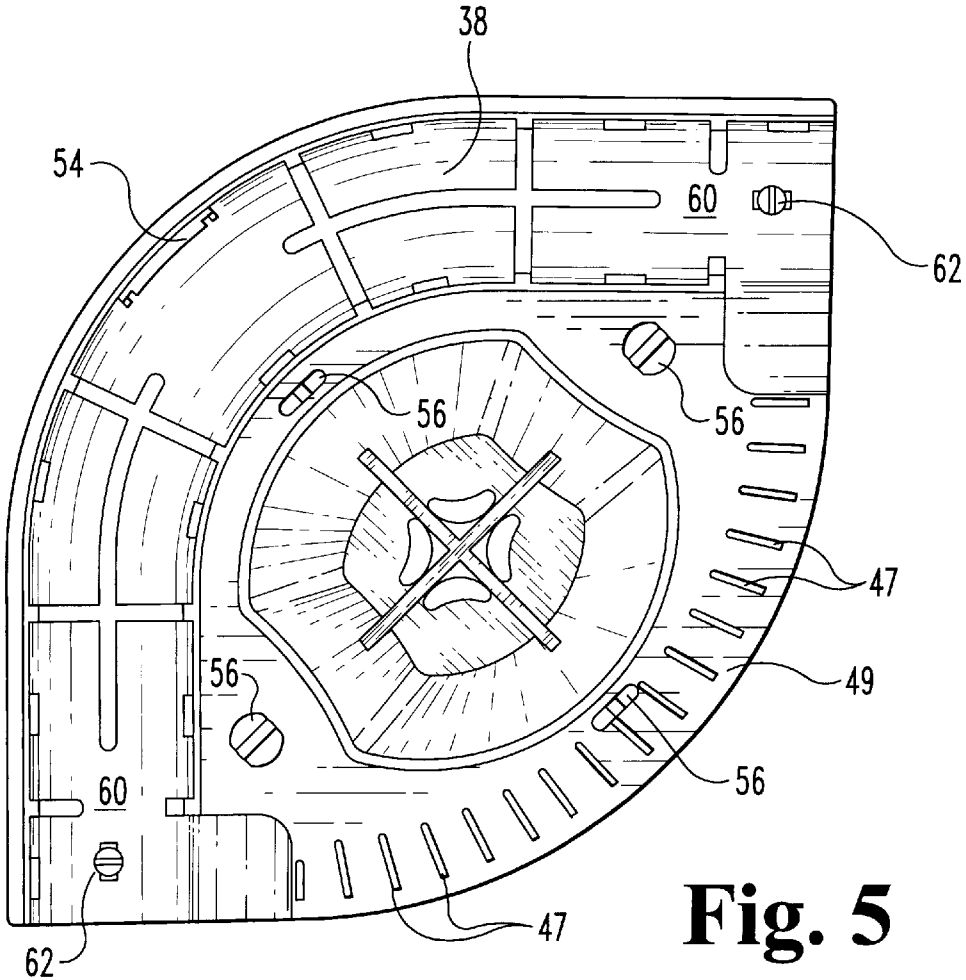
FIG. 5 is a top view of the lower portion of the corner piece illustrated in FIG. 3.

Lower portion 38 is illustrated in a top, disassembled view in FIG. 5. Lower portion 38 defines a groove 60 sized and shaped to receive a portion of frame 14 such as a tube. Lower portion further includes connection tabs 54 and slots 56. Tabs 54 extend to be fitted into matching slots 56 in upper portion 37, and slots 56 in lower portion 38 are matched to tabs 54 extending from upper portion 37. For further stability and rigidity of the frame, extended tabs 62 are located within groove 60 with a height to extend through pre-drilled openings in frame 14. The inner edge 49 of lower portion 37 extends beyond pocket 31 towards the interior of frame 14 and preferably includes grip tabs 47 for holding bedding material.

Figure 6:
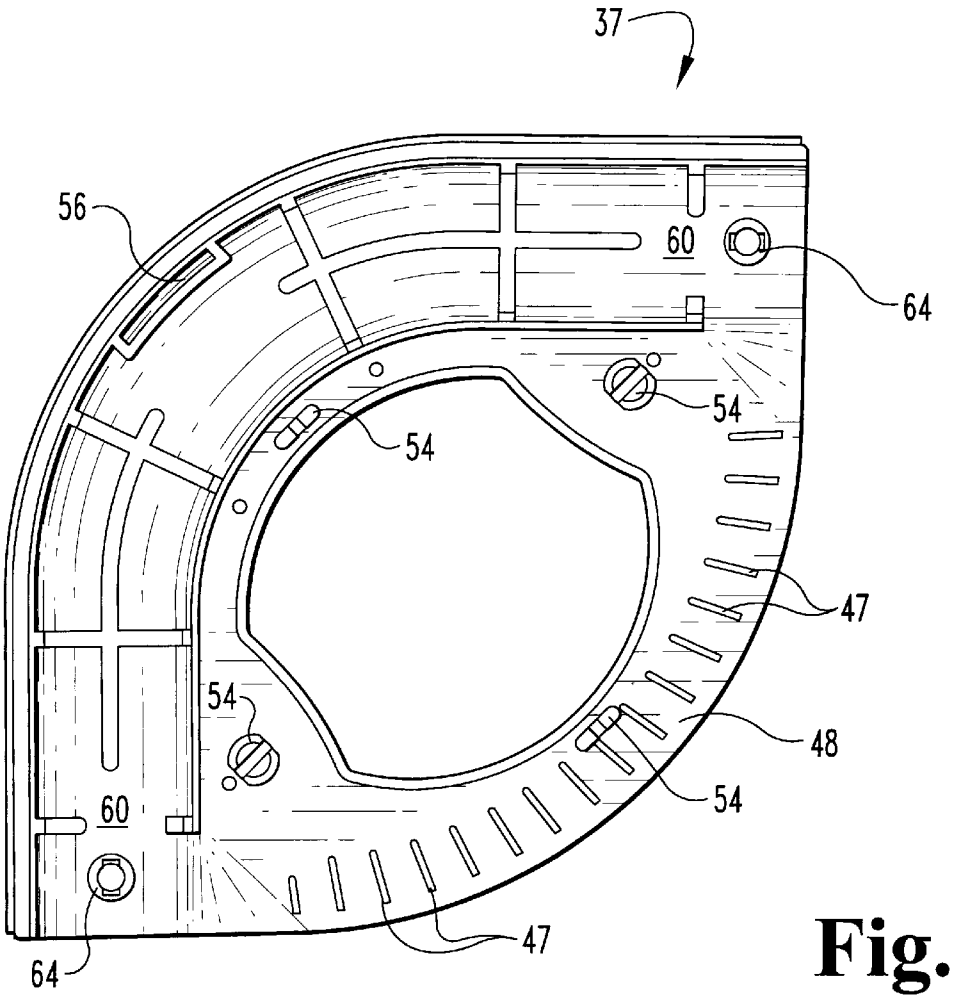
FIG. 6 is a bottom view of the upper portion of the corner piece illustrated in FIG. 3.

Upper portion 37 is illustrated in a bottom view in FIG. 6. Upper portion 37 is configured to be placed in alignment with lower portion 38 during assembly. Upper portion 37 includes the corresponding slots 54 and tabs 56 to match with the tabs and slots from lower portion 38. Upper portion 37 also includes groove 60 sized and shaped to receive a portion of frame 14. Slots 64 are defined in groove 60 to receive the extended tabs 62 which project through frame 14. An upper flange 48 extends from upper portion 37 to be aligned over inner edge 49 of lower portion 38 and includes grip tabs 47 for holding bedding material.

Figure 7:
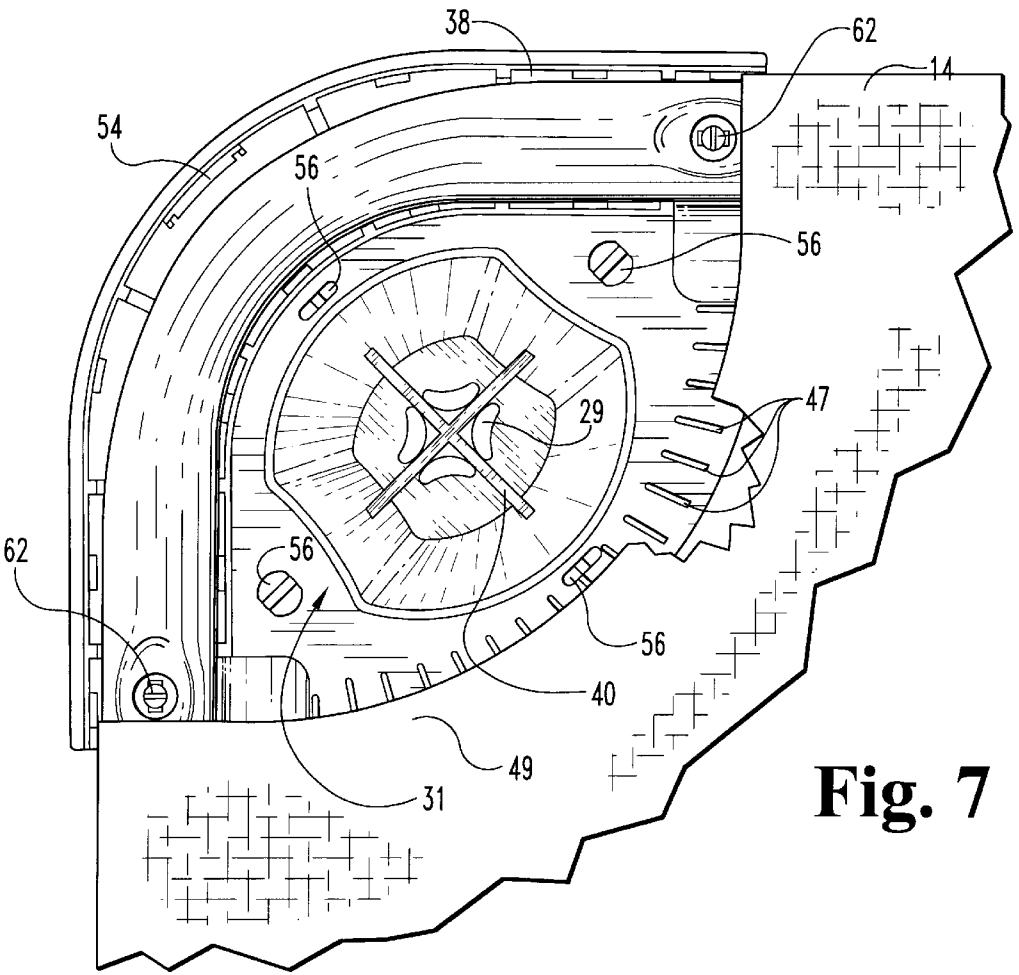
FIG. 7 is a top view of the lower portion of the corner piece and tube illustrated in FIG. 3.

For assembly, a portion, such as a corner, of frame 14 is placed into groove 60 of lower portion 38 with connection tabs 62 extending through frame 14 (FIG. 7). In a preferred embodiment, a curved portion of frame 14 is placed in groove 60. Attaching corner piece 30 to a curved portion of frame 14 adds stability at a support point for the forces acting on the frame and prevents rotation of corner piece 30 with respect to frame 14.

Bedding material 20 attached to frame 14 is arranged to lie over the inner edge 49 of lower portion 38 and over grip tabs 47 without extending into pocket 31. Upper portion 37 is then aligned over lower portion 38 to snugly receive frame 14, with upper flange 48 and grip tabs 47 aligned over bedding material 20. Upper portion 37 and lower portion 38 form slot 46 between upper flange 48 and inner edge 49. Slot 46 includes grip tabs 47. Upper portion 37 and lower portion 38 are pressed together so that tabs 54 and 62 "snap" to engage and interlock with slots 56 and 64 to hold corner piece 30 together. In a preferred embodiment, the outside edges of upper portion 37 and lower portion 38 exterior to frame 14 may include a tongue-in-groove nesting feature (not shown) for further strength and to eliminate exterior gaps.

Thus, the risk of injury or damage due to a person's hands, fingers, feet, etc. being stuck in openings or gaps between frame 14 and bedding material 20 is eliminated.

Figure 8:
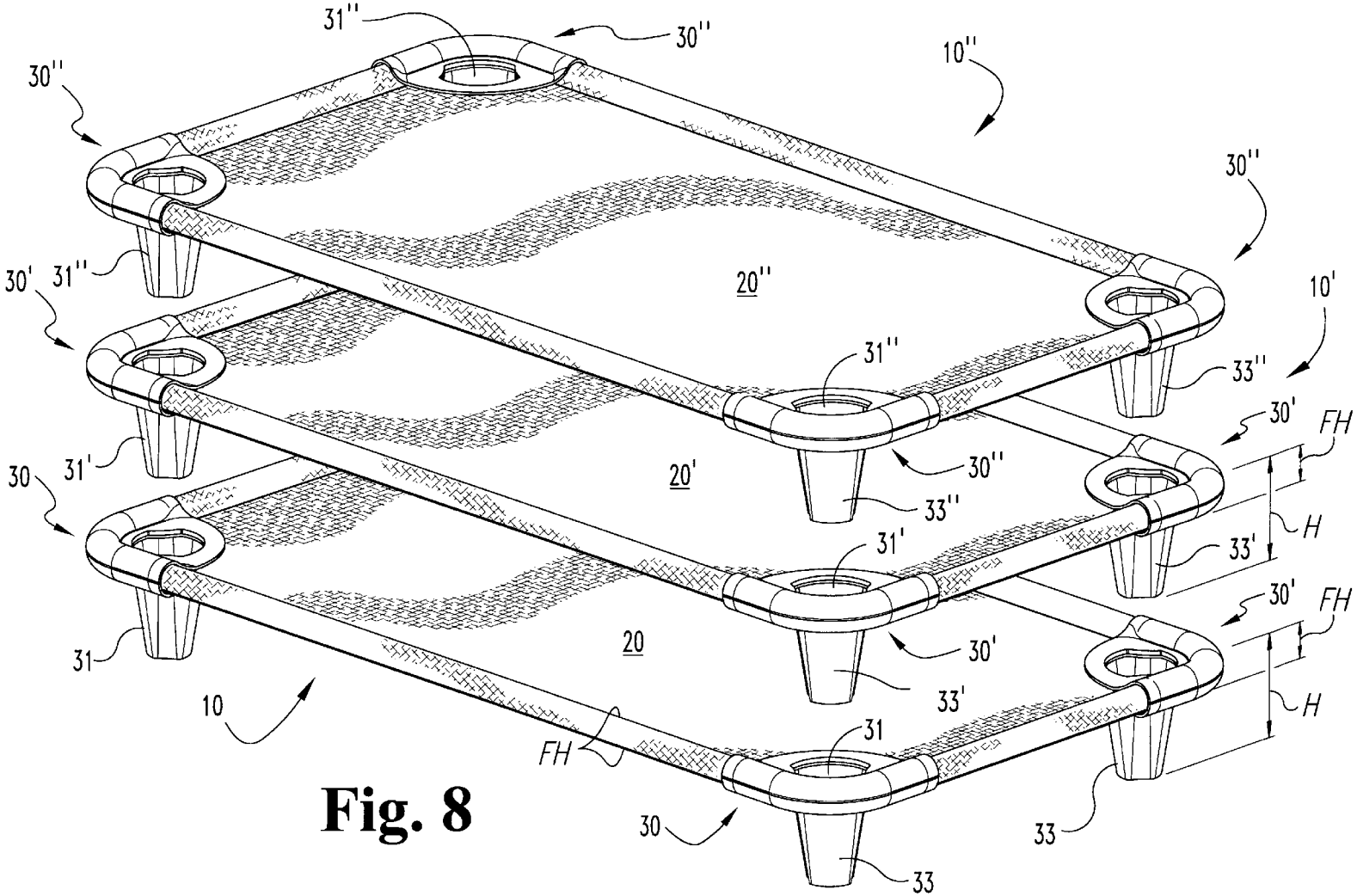
FIG. 8 is a perspective view of three stackable cot assemblies of FIG. 1.

Referring to FIG. 8, each of the corner pieces 30 defines a pedestal 33 and pocket 31 that allows a plurality of cots 10 to be nestably stacked one upon another. The inner walls of pocket 31 define a shape to slidably and removably receive the pedestal 33' of a second cot with the outer surface of the received pedestal in close or abutting contact with the inner walls of pocket 31. As an example, FIG. 8 illustrates three cots 10, 10', and 10" nestably stackable one on top of the other. Each of the corner pieces 30, 30', 30" includes a pedestal 33, 33', 33" extending therefrom which can be nested into a pocket 31, 31', 31".

In the preferred embodiment, pedestal 33 of each corner piece 30 extends downwardly from within the interior area of continuous frame 14. The improved construction of corner pieces 30, holding a wrap-around portion of frame 14 without additional or complex connector pieces, allows the pedestals to be located within the interior of frame 20 without bedding material 20 overlapping pedestal 33 or pocket 31 to interfere with stacking.

The simplicity of the preferred embodiment shown allows the frame to be mounted to low profile corner pieces at a height independent of the height of the pedestal. Since the pedestal/pocket passes between the frame and the bedding material, the top of the pedestal can be lower than, equal to or higher than the level of the bedding material. In the preferred embodiment illustrated, the level of the bedding material is substantially equal with the top of the pedestal so that the diameter of the frame substantially overlaps but extends slightly higher than the top of the pedestal.

Figure 9:
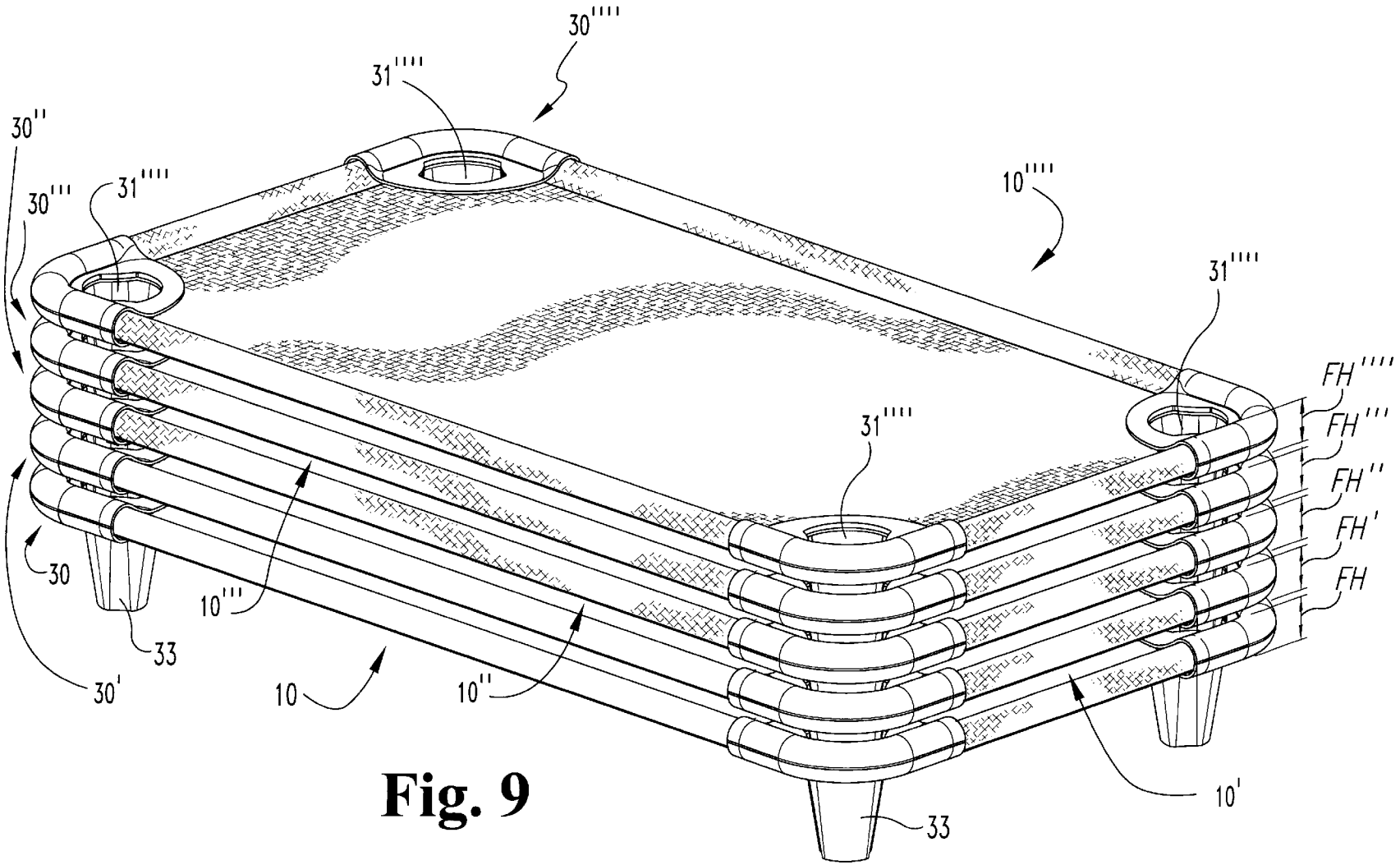
FIG. 9 is a perspective view of a stack of cot assemblies.

FIG. 9 illustrates a nested stack of cot assemblies. Each cot assembly 10, 10', 10", 10'", and 10"" includes corner pieces 30, 30', 30", 30'" and 30'" with pedestals and pockets. At least a portion of the height of a pedestal of each cot assembly is received in the corresponding pocket of the cot below. The lowest pedestal 33 and the top pocket 31"" remain visible. Each cot assembly has a height H, however, the stacked height of cots 10, 10', 10", 10" and 10"" is less than the sum of the heights H of the individual cots. Preferably, the interface between the inner walls of pocket 31 and the outer surface 42*a*, 42*b* of the received pedestal is such that a plurality of cots may be easily stacked and unstacked with minimum exertion or effort. Further, the fit is desirably close enough that it provides stability to a stack of cots.

By being mounting independently from the pedestal, the frame height FH, meaning the diameter of frame 14 including clearance for the outside diameter of groove 60, is the only height which cannot be nested. The cots are configured for stacking and nesting to a point where each additional cot adds only a height FH to the stack. As illustrated in FIG. 9, preferably the height of five nested cot assemblies is the height of the first cot assembly H plus the frame height FH of the four stacked cot assemblies. (Total height=H+4FH).

Inner supports 40 within each pedestal serve to limit the nesting distance to prevent jamming between nested pedestals. This improved nesting relationship allows a larger number of cots to be stacked within the same height or the same number of cots has a lower profile. For example, twenty cots in accordance with the present invention can be stacked within the height formerly required by ten cots.

Figure 10:
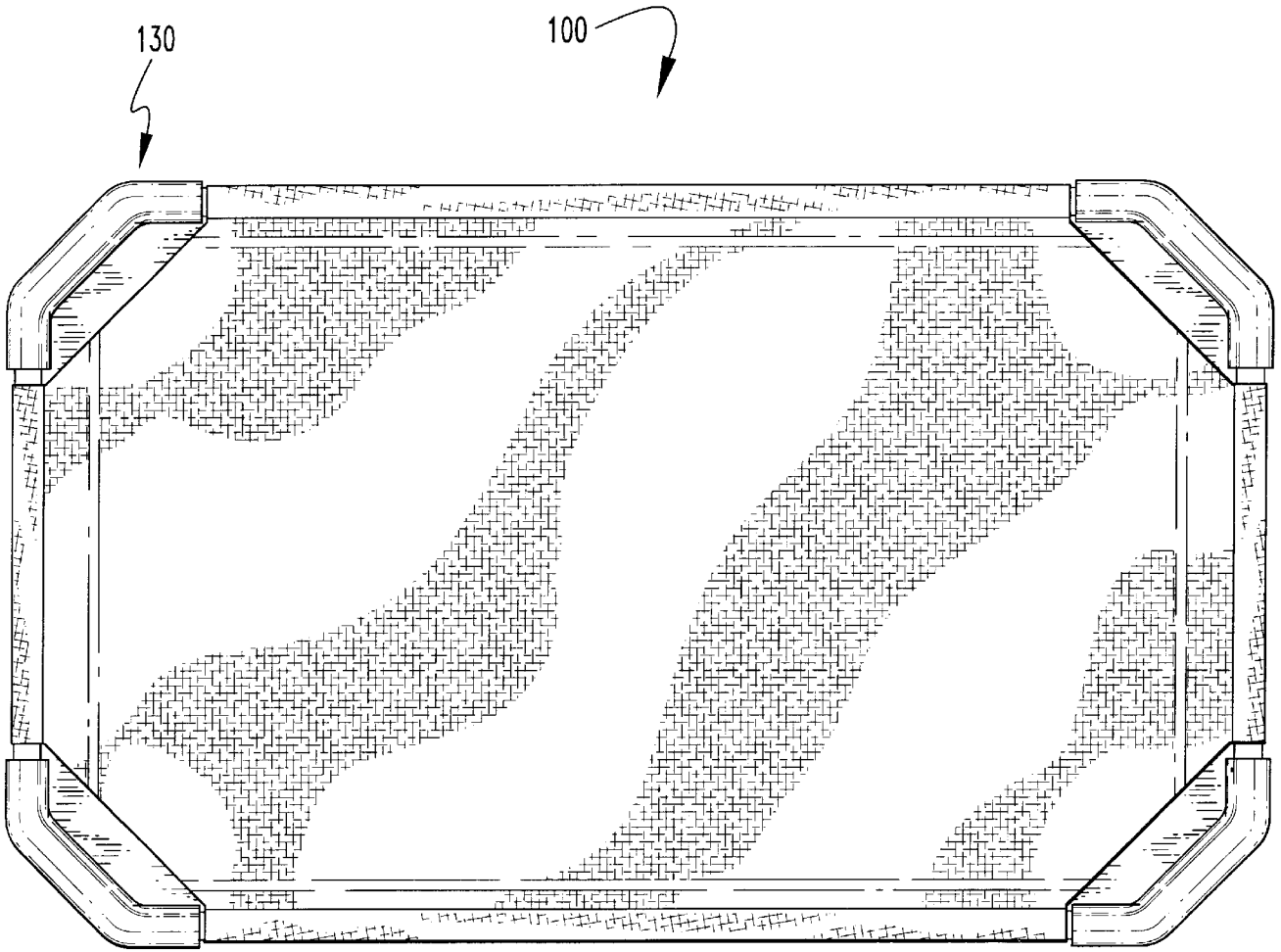
FIG. 10 is a top plan view of a cot assembly according to an alternate preferred embodiment of the present invention.

Illustrated in FIG. 10 is an alternate preferred embodiment of the present invention with a cot 100. Cot 100 includes corner pieces 130. Cot 100 and corner pieces 130 are functionally substantially similar to cot 10 and corner pieces 30 with geometric differences in the size and shape of corner pieces 130 and corresponding pedestals and pockets. In certain less preferred embodiments of cot 100, the bedding material may define gaps between the bedding material and the interior edges of the corner pieces.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A cot assembly, comprising:

a) a continuous frame forming a perimeter and defining an interior area within the perimeter;

b) bedding material secured to said frame;

c) support means partially enclosing at least a portion of said frame, at least partially within the interior area of said frame and extending to support said frame above an external support surface; and, d) wherein said bedding material completely fills the interior area defined by said frame and said support means, whereby there are no gaps between said bedding material and said frame and support means in which a part of a person's body may be received.

2. The cot assembly of claim 1 wherein said frame forms a polygonal shape having a plurality of corners.

3. The cot assembly of claim 2 wherein said support means is comprised of a plurality of corner pieces mounted to said frame at least at each of said plurality of corners.

4. The cot assembly of claim 3 wherein said frame includes curved portions and wherein each said corner piece encloses a curved portion of said frame.

5. The cot assembly of claim 4 in which said bedding material is secured to the frame and to said corner pieces.

6. The cot assembly of claim 5 wherein each said corner piece includes a pedestal extending downwardly from said frame to raise the corner piece, above an external support service.

7. The cot assembly of claim 6 wherein each said corner piece defines a slot within the perimeter of said frame wherein said bedding material is received within said slot.

8. The cot assembly of claim 6 wherein each said corner piece includes a pocket defined within said pedestal, wherein said pocket is configured for nestably receiving a pedestal of a second cot assembly.

9. A cot assembly, comprising:

a) a one or two piece frame forming a perimeter and defining an interior area within the perimeter;

b) bedding material secured to said frame;

c) a corner piece having a lower portion and an upper portion;

d) wherein said lower portion includes:

i) a pedestal extending downwardly;

ii) a pocket defined within said pedestal; and, iii) a groove extending across said lower portion and configured to receive a portion of said frame;

e) wherein said upper portion includes:

i) a groove extending across said upper portion and configured to receive a portion of said frame; and, ii) a pocket opening configured to be aligned with said pocket; and, f) means for connecting said upper portion to said lower portion to form a corner piece gripping said frame, wherein said frame extends through said groove and wherein said pedestal supports said frame a distance above an external support service.

10. The cot assembly of claim 9 wherein said upper portion includes an upper flange and said lower portion includes an inner edge, wherein said upper flange and said inner edge define a slot extending within the interior area of said frame's perimeter to receive said bedding material.

11. The cot assembly of claim 10 further comprising grip tabs mounted on said upper flange and said inner edge within said slot to grip said bedding material.

12. The cot assembly of claim 11 wherein said means for connecting said upper portion and said lower portion include connection tabs and slots in said upper portion aligned with corresponding connection tabs and slots in said lower portion interlockable to connect said upper portion to said lower portion.

13. The cot assembly of claim 12 wherein at least one of said connection tabs extends a height through said frame.

14. The cot assembly of claim 12 wherein said upper portion is formed as one piece of molded plastic.

15. The cot assembly of claim 14 wherein said lower portion is formed as one piece of molded plastic.

16. The cot assembly of claim 15 wherein said connection tabs and slots are molded into said upper portion and said lower portion.

17. A cot assembly, comprising:

a) a one or two piece frame forming a perimeter and defining an interior area within the perimeter;

b) bedding material secured to said frame across said interior area;

c) a corner piece mounted around a portion of said frame and having a portion extending within the perimeter of said frame;

d) a pedestal extending downward from the portion of said corner piece within the perimeter of said frame to support said frame above an external supporting surface, wherein said pedestal defines a cross-sectional shape, and wherein said pedestal downwardly tapers to a reduced cross-sectional area; and, e) a pocket defined downwardly within said pedestal and having the cross-sectional shape of said pedestal, wherein said pocket downwardly tapers to a reduced cross-sectional area in correspondence to the taper of said pedestal, and wherein said pocket is configured to slidably and removably receive the pedestal of a second cot assembly.

18. The cot assembly of claim 17 further comprising a second cot assembly identical to said first cot assembly and stackable upon said first cot assembly, wherein each pedestal extending from a corner piece of said second cot assembly is slidably received within a pocket defined in a corner piece of said first cot assembly.

19. The cot assembly of claim 18 wherein the frame of said second cot assembly has a height, and wherein the difference in height of said first cot assembly and the stack of said second cot assembly stacked upon said first cot assembly is substantially equal to the height of the frame of said second cot assembly.

20. A combination comprising a plurality of stackable cot assemblies in accordance with claim 17 wherein said cot assemblies are vertically stacked such that each pocket in a cot assembly slidably receives a corresponding pedestal of the cot assembly placed atop it.

21. The combination of claim 20 wherein the frame of each cot assembly has a height and wherein the height of the stacked cot assemblies is increased by approximately the height of a frame each time a cot assembly is placed atop the stack.

22. The combination of claim 17 wherein said pedestal is downwardly tapered along its length and wherein said pocket is downwardly tapered along its length in correspondence to the taper of said pedestal.

23. The combination of claim 22 wherein said pedestal is continuously tapered along its length and wherein said pocket is continuously tapered along its length.

24. The combination of claim 17 wherein said bedding material completely fills the interior area defined by said frame and said corner piece, whereby there are no gaps between said bedding material and said frame and said corner piece in which a part of a person's body may be received.

* * * * *